US005826971A

United States Patent [19]

Kibler

[11] Patent Number: 5,826,971

[45] Date of Patent: Oct. 27, 1998

[54] SLIDE FOCUS FLASHLIGHT

[75] Inventor: Gary W. Kibler, Flower Mound, Tex.

[73] Assignee: Nordic Lights, Inc., Fort Worth, Tex.

[21] Appl. No.: 687,157

[22] Filed: Jul. 24, 1996

Related U.S. Application Data

[60] Provisional application No. 60/015,236 Apr. 10, 1996.

[51] Int. Cl.[6] ..... F21L 7/00

[52] U.S. Cl. ..... 362/188; 362/187; 362/203

[58] Field of Search ..... 362/187, 188, 362/203, 205, 208

[56] References Cited

U.S. PATENT DOCUMENTS

| | | | |
|---|---|---|---|
| D. 267,514 | 1/1983 | Leung | D26/37 |
| D. 268,175 | 3/1983 | Kong | D10/114 |
| D. 308,253 | 5/1990 | Battles et al. | D26/38 |
| D. 350,618 | 9/1994 | Parker | D26/37 |
| D. 351,245 | 10/1994 | Maglica | D26/49 |
| D. 360,044 | 7/1995 | Tillery | D26/49 |
| D. 362,735 | 9/1995 | Hiromori | D26/37 |
| D. 366,338 | 1/1996 | Garrity | D26/49 |
| D. 366,708 | 1/1996 | Santarsiero | D26/37 |
| D. 366,709 | 1/1996 | Szmanski | D26/43 |
| 1,674,650 | 6/1928 | Leser | 362/188 |
| 1,778,039 | 10/1930 | Rogge | 362/187 |
| 1,958,796 | 5/1934 | Mercer | 362/187 |
| 2,125,038 | 7/1938 | Tompkins et al. | 362/208 X |
| 2,816,215 | 12/1957 | Jarred | 240/10.6 |
| 2,832,968 | 5/1958 | Knudsen | 9/8.3 |
| 4,376,965 | 3/1983 | Bacevius | 362/191 |
| 4,398,238 | 8/1983 | Nelson | 362/187 |
| 4,432,043 | 2/1984 | Yuen | 362/184 |
| 4,443,833 | 4/1984 | Fazzina | 362/189 |
| 4,533,982 | 8/1985 | Kozar | 362/183 |
| 4,570,208 | 2/1986 | Sassmannshausen | 362/188 |
| 4,648,013 | 3/1987 | Curiel | 362/183 |
| 4,794,315 | 12/1988 | Pederson et al. | 320/2 |
| 4,823,242 | 4/1989 | Maglica et al. | 362/187 |
| 4,841,417 | 6/1989 | Maglica et al. | 362/206 |
| 4,843,526 | 6/1989 | Price, III | 362/187 |
| 4,868,724 | 9/1989 | Tung | 362/189 |
| 4,903,178 | 2/1990 | Englot et al. | 362/183 |
| 4,916,588 | 4/1990 | Chu | 362/203 |
| 4,956,755 | 9/1990 | Maglica et al. | 362/206 |
| 4,987,523 | 1/1991 | Lindabury et al. | 362/188 |
| 5,142,458 | 8/1992 | Brunson | 362/194 |
| 5,143,441 | 9/1992 | Maglica | 362/263 |
| 5,158,358 | 10/1992 | Maglica et al. | 362/206 |
| 5,171,086 | 12/1992 | Baloochi | 362/188 |
| 5,197,796 | 3/1993 | Moore | 362/202 |
| 5,239,451 | 8/1993 | Menke et al. | 362/199 |
| 5,287,255 | 2/1994 | Strodtman | 362/102 |
| 5,349,507 | 9/1994 | Parker | 362/158 |
| 5,400,227 | 3/1995 | Maglica et al. | 362/206 |
| 5,424,927 | 6/1995 | Schaller et al. | 362/157 |
| 5,461,551 | 10/1995 | Clayton | 362/183 |
| 5,461,552 | 10/1995 | Tillery | 362/188 |
| 5,485,360 | 1/1996 | Maglica | 362/158 |
| 5,560,705 | 10/1996 | Shiau | 362/188 |

OTHER PUBLICATIONS

International Search Report dated Jul. 24, 1997 for International Application No. PCT/US97/05992.

*Primary Examiner*—Stephen F. Husar
*Attorney, Agent, or Firm*—Baker & Botts, L.L.P.

[57] ABSTRACT

A method and apparatus for selectively focusing a flashlight are provided. The apparatus includes a flashlight (10) having a flashlight body (12) with a cavity (32) therein and further having an actuator-receiving opening (204) through a portion of the flashlight body. A reflector (90) for reflecting light and a lamp (24) for producing light are disposed within the cavity (32). A housing assembly (302) is disposed within the cavity and moveable therein. The housing assembly includes a housing (34). An actuator (30) extends into the actuator-receiving opening and couples to the housing. The lamp and reflector are associated with the housing assembly whereby movement of the housing assembly allows relative movement of the lamp and the reflector to allow focusing of light from the lamp when an operator causes the actuator to move. According to the method of the invention, a flashlight (10) is selectively focused by selectively sliding an actuator (30) that is connected to a moveable lamp assembly (302) having a lamp (24). The actuator is on the exterior surface of the flashlight body and is slid in a direction approximately parallel to a longitudinal axis of the flashlight body. In this manner the lamp housing assembly is selectively positioned relative to the reflector (90).

29 Claims, 3 Drawing Sheets

SLIDE FOCUS FLASHLIGHT

RELATED APPLICATIONS

This application claims the benefit of U.S. provisional application No. 60/015,236, filed Apr. 10, 1996 to the extent of the common subject matter of both applications.

TECHNICAL FIELD OF THE INVENTION

This invention relates in general to flashlights and more particularly to a slide focus flashlight.

BACKGROUND OF THE INVENTION

Flashlights with a power switch and mechanisms to adjust the beam of light have been developed. For example, see the following U.S. Pat. Nos.: 5,158,358 and 4,916,588. These devices, however, have certain disadvantages. One disadvantage in many such devices is that they are awkward or impossible to turn on and focus without requiring two hands. This deficiency was recognized and some effort was made to resolve it.

U.S. Pat. No. 5,171,086 to Baloochi is an example of an effort to address some of the deficiencies. Baloochi shows a hand-held adjustable focus flashlight involving numerous parts and complexity, which typically translates into relatively high manufacturing costs and issues of reliability with all the moving parts. As another example of a complex attempt to address problems in creating a focusable flashlight for operation with one hand, some have proposed using devices with pinned cams that at the extremes operate the power switch and in intermediate positions use the cam to move the lamp relative to the reflector to focus the flashlight.

SUMMARY OF THE INVENTION

Therefore, a need has arisen for a focusable flashlight capable of operation by a single hand of the operator that is relatively easy to manufacture. According to an aspect of the present invention a flashlight is provided having a flashlight body with a cavity therein and further having an actuator-receiving opening through a portion of the flashlight body. A reflector for reflecting light and a lamp for producing light are disposed within the cavity. A housing assembly is disposed within the cavity and moveable therein. The housing assembly includes a housing. An actuator extends into the actuator-receiving opening and couples to the housing. The lamp and reflector are associated with the housing assembly whereby movement of the housing assembly allows relative movement of the lamp and the reflector to allow focusing of light from the lamp when an operator causes the actuator to move.

According to another aspect of the present invention, a focusable flashlight is provided that includes a body having a cavity therein, the body formed with an actuator-receiving aperture. A head is coupled to a first end of the body and a reflector is coupled to the head. A lamp with first and second electrical contacts for producing light when energized is also provided as part of the flashlight. The flashlight further includes an actuator slidable within the actuator-receiving aperture and a housing assembly disposed within the cavity and slidable therein for mechanically coupling the lamp to the actuator. The housing assembly includes a housing having an end and an interior with the housing coupled to the actuator; and a conductive, longitudinal shaft protruding from the end of the housing and into the interior of the housing, the shaft having a first end and a second end with the first end electrically coupled to the first electrical contact on the lamp. The flashlight is selectively focused by movement of the actuator in the actuator-receiving aperture, which causes the housing assembly to slide relative to the reflector, causing the lamp to move relative to the reflector.

According to another aspect of the present invention a method is provided for selectively focusing a flashlight having a body with an exterior surface and having a reflector. The method includes the steps of selectively sliding an actuator on the exterior surface of the flashlight body in a direction approximately parallel to a longitudinal axis of the body. The actuator is connected to a moveable housing assembly having a lamp. In this manner the lamp is selectively positioning relative to the reflector.

A technical advantage of the present invention is that it may be relatively easy to manufacture when compared with conventional focusable flashlights.

Another technical advantage of the present invention is that it may be focused and selectively energized by a single hand of an operator.

BRIEF DESCRIPTION OF THE DRAWINGS

For a more complete understanding of the present invention and the advantages thereof, reference is now made to the following written description taken in conjunction with the accompanying drawings, in which.

DETAILED DESCRIPTION OF THE INVENTION

The preferred embodiments of the present invention and its advantages are best understood by referring to FIGS. 1–4 of the drawings, like numerals being used for like and corresponding parts of the various drawings.

Figure 1:
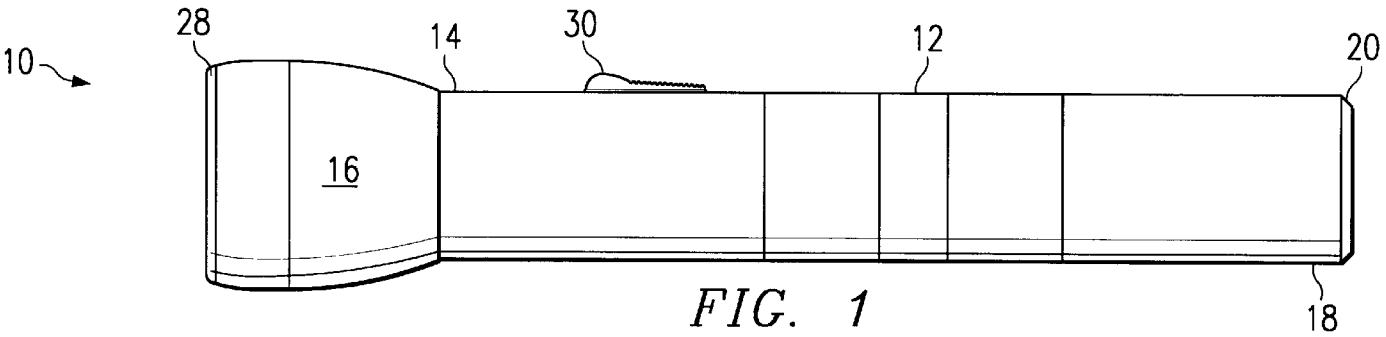
FIG. 1 is a perspective view in elevation of a flashlight according to one aspect of the present invention.
Figure 2:
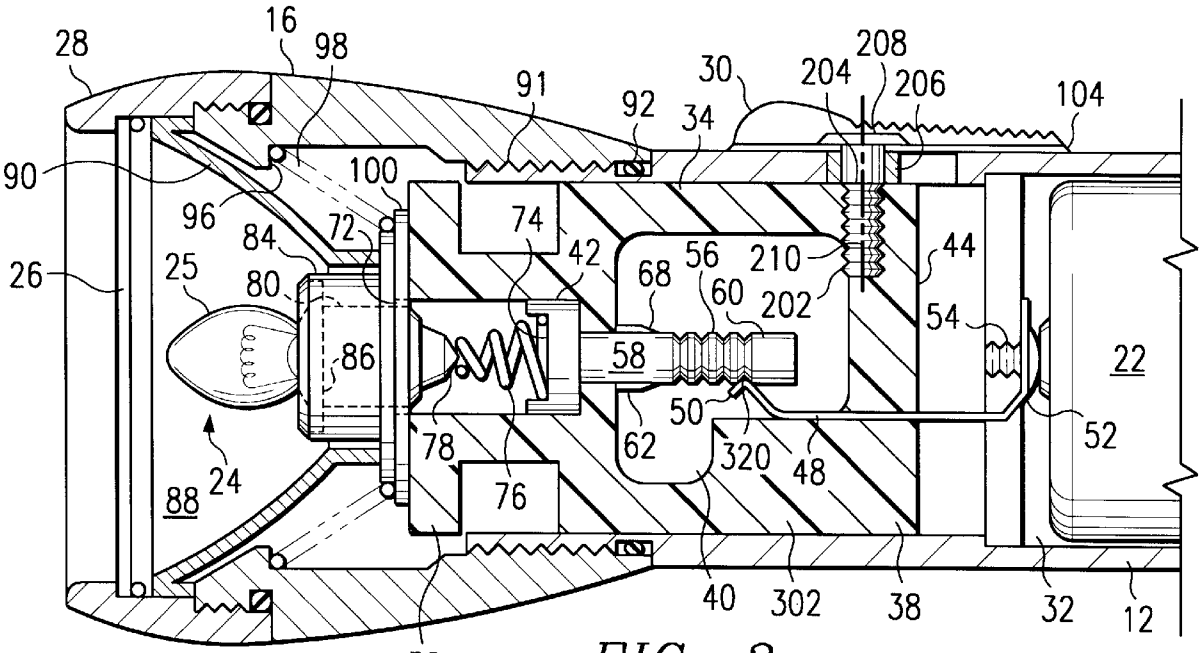
FIG. 2 is a cross sectional view of a portion of the flashlight of FIG. 1 with the switch in a first extreme position.

Referring to FIGS. 1 AND 2 a flashlight 10 has a main body 12, which is part of flashlight container or body. Removably coupled to a first end 14 of body 12 is head 16. Removably coupled to a second end 18 of body 12 is an end cap 20. End cap 20 may be removed to place batteries 22 (FIG. 2) in flashlight 10. Head 16 may be removed from body 12 to allow access to lamp 24 of FIG. 2. Protecting lamp 24 is a lens 26 (FIG. 2), which may be held in place by a lens ring 28. Slidably attached to an exterior portion of body 12 is an actuator or combination-switch-and-focus actuator 30. Actuator 30 is arranged to move relative to body 12.

Referring to FIG. 2, body 12 is formed with a cavity 32 formed therein. Disposed within cavity 32 and slidably coupled to body 12 is a housing assembly or lamp housing assembly 302 for positioning flashlight elements, such as the lamp assembly 24 and reflector 90, relative to each other. In the embodiment shown in FIGS. 1–3, housing assembly 302 includes a housing 34, a shaft 56 fixedly attached to housing 302 through collar 62, collar 62, and lamp assembly 24. In other embodiments, housing assembly 302 may include reflector 90 in place of lamp 24. In still other embodiments, housing assembly 302 may include solely one of the above elements, such as housing 34 or lamp 24.

Housing 34, which is slidable within cavity 32, may be made from polypropylene, or other plastics. Housing 34 has a first end 36 and a second end 38, and is formed with a cavity 40. A first aperture 42 is formed on first end 36 of housing 34. A second aperture 44 is formed on second end 38 of housing 34. Connected to housing 34 is screw 202, which extends from the housing 34 through an actuator-receiving aperture 204 formed in the main body 12. Screw 202 further extends through a spacer 206 and through an actuator aperture 208 in actuator 30 to secure actuator 30 to body 12. Actuator 30 is slidable along the surface of body 12 within an actuator track 104. Spacer 206 reduces friction between actuator 30 and track 104 to allow sliding of actuator 30 within actuator track 104. Screw 202 is received in housing 34 through a screw aperture 210 formed in the housing 34.

Figure 3:
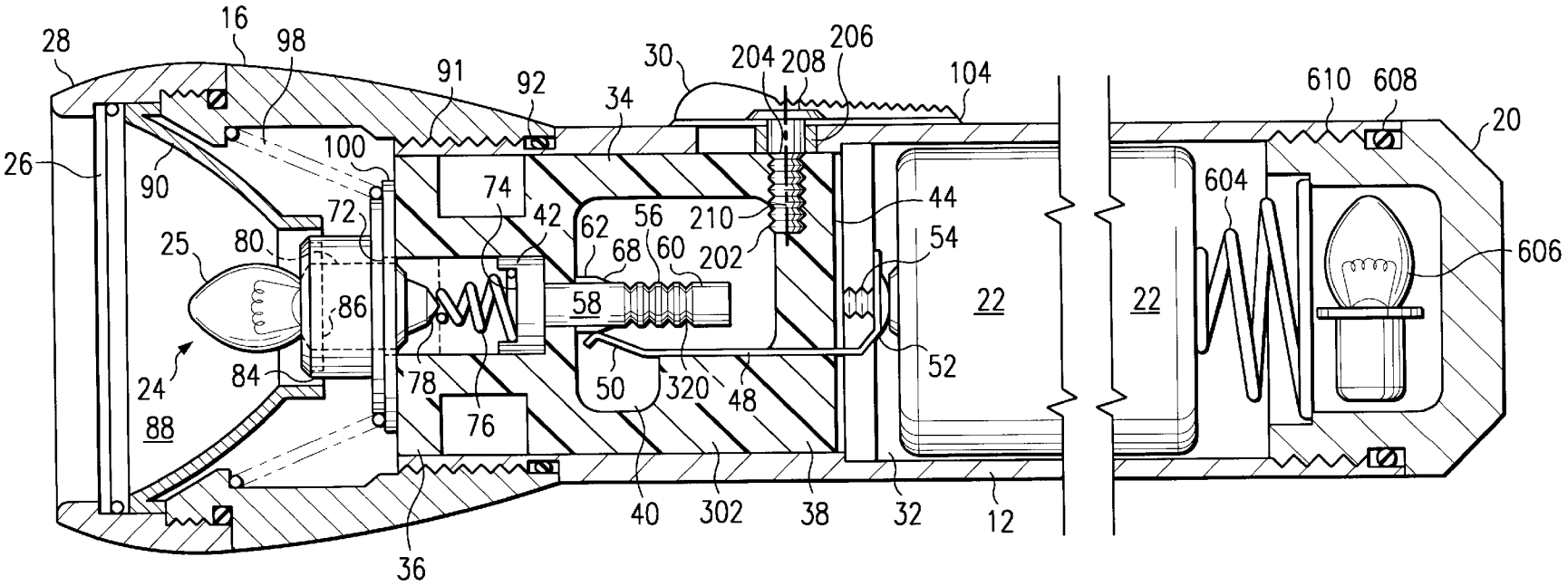
FIG. 3 is a cross sectional view of a portion of the flashlight of FIG. 1 with the switch in a second extreme position.

Cavity 32 of body 12 may also have batteries 22 disposed therein and abutting end cap spring 604 in end cap 20 (FIG. 3). Size "D" cell batteries are shown but, in other embodiments, other sizes may be used such as size "AA" or size "C." End cap spring 604 urges batteries 22 in the direction of the first end 14. End cap spring 604 also serves to provide an electrical connection between the body 12 and the batteries 22. End cap 20 may be removably attached to body 12 at second end 18 through mating threads 610 (internal threads on end 18 and external threads on end cap 20). A spare lamp assembly 606 may be stored within end cap 20, as shown in FIGS. 2 and 3. O-rings 608 may be provided between end cap 20 and second end 18 to seal moisture out of end cap 20.

A conductive slide shoe 48 may be electrically coupled to a positive contact of battery 22. Slide shoe 48 may have a first end 52 and a second end 50. First end 52 of slide shoe 48 may be secured to shock plate 502 by a fastener 54. Shock plate 502 separates cavity 32 from batteries 22. Fastener 54 also may serve to electrically couple slide shoe 48 to the positive contact of battery 22.

As part of housing assembly 302 in the embodiment shown in FIGS. 2 and 3, a longitudinal, conductive shaft 56 may be disposed within cavity 32 and further disposed through first aperture 42 and through cavity 40 of actuator housing 34. Shaft 56 has a first end 58 near aperture 42 and a second end 60 near aperture 44. Coupled to first end 58 of conductive shaft 56 is collar 62, which is in turn coupled to housing 34. Conductive shaft 56 may be formed with a plurality of indentations 320 for engagement with slide shoe 48. The indentations selectively maintain the housing 34 in place to hold a desired focus for flashlight 10. Collar 62 is formed of an insulated material and may be formed as an integral part of housing 34. Collar 62 is formed with a shoulder 68. Near collar 62 on housing 34 is lamp-receiving cavity 72.

Lamp assembly 24 is disposed within lamp-receiving cavity 72. Also, disposed within cavity 72 or a portion of cavity 72 is spring retaining cup 74 of first end 58 of shaft 56. Spring retaining cup 74 is designed to receive and hold an end of lamp spring 76, which is a conductive metal spring. Spring 76 electrically couples conductive shaft 56 with positive contact 78 of lamp assembly 24. Lamp assembly 24 also has a lamp jacket 80 and bulb 25. Lamp jacket 80 is electrically coupled with shaft 56. Once lamp assembly 24 is placed within lamp-receiving cavity 72, it may be held in place by lamp retainer 84, which depresses on lamp flange 86. Lamp retainer 84 may attach to a portion of housing 34. Lamp assembly 24 extends through lamp-receiving aperture 88 in reflector 90, which is preferably a parabolic reflector.

Reflector 90 rests against a portion of head 16 and may be held in place by a portion of lens ring 28. Head 16 may be removably attached to body 12 at first end 14 by mating threads 91 (internal threads on head 16 and external threads on body 12). O-rings 92 may be provided between head 16 and body 12 to seal moisture out of cavity 32. Lens 26 may be held by lens ring 28 in a secured manner and in a manner that provides a moisture barrier. Lens ring 28 is secured to head 16 in a removable fashion and also provides a moisture barrier to help protect the internal components within cavity 32. Shoulder 96 on head 16 may be formed to resist or interact with conductive spring 98.

Conductive spring 98 provides a separating force between shoulder 96 and lamp retainer shoulder 100. Conductive spring 98 serves at least two functions. First, it urges lamp retainer 84 and the components coupled to it, such as shaft 56 and housing 34, away from shoulder 96 and towards second end 18 of flashlight 10. Second, conductive spring 98 contributes to the negative contact of a circuit required for illumination of lamp assembly 24.

In one embodiment, the lamp circuit uses body 12 as part of a circuit for providing energy to the lamp assembly 24. The negative contact of batteries 22 couples with end cap spring 604 (FIG. 3), which in turn is electrically coupled to end cap 20, which is electrically coupled to body 12 through metal-on-metal contact of threads 610. Body 12 is preferably aluminum and is electrically coupled to head 16 by metal-on-metal contact of threads 91, which in turn is electrically coupled through spring 98 to lamp retainer 84, which is electrically coupled to lamp jacket 80. The positive electrical input for the lamp assembly 24 is provided from positive contact of battery 22 to fastener 54 to slide shoe 48 to conductive shaft 56 to lamp spring 76 and finally to positive contact 78. Whether the circuit for lamp assembly 24 is energized is determined by whether slide shoe 48 is in contact with shaft 56 as will be described further below.

In operation, flashlight 10 allows an operator to hold flashlight 10 and turn it ON and focus it with a single hand. Referring to FIG. 2, flashlight 10 is shown in the first extreme position, which is an ON, beam-focused position. In this position, actuator 30 has been moved to its forwardmost position, i.e., the position of actuator 30 nearest to first end 14. Referring to FIG. 3, flashlight 10 is shown in the second extreme position which is an OFF position. As actuator 30 is slid along actuator track 104 from a second extreme position (FIG. 3) toward the first extreme position (FIG. 2), the housing assembly 302, including housing 34, shaft 56, and lamp assembly 24, is moved laterally towards first end 14, compressing spring 98. As the housing assembly 302 moves toward first end 14, it causes lamp assembly 24 to extend further into the lamp-receiving cavity 88 of reflector 90. The relative movement of lamp assembly 24 with respect to reflector 90 changes the focus of flashlight 10, eventually going to a full-beam position (even beyond) when it is in this extreme position as shown in FIG. 2. As actuator 30 is moved toward the rear of flashlight 10 or second end 18 (i.e. from the first extreme position to the second extreme position), housing assembly 302 moves toward second end 18. As this occurs, lamp assembly 24 is moved toward second end 18 through lamp-receiving cavity 88, thus moving lamp assembly 24 more and more towards a flood-focus position, which may exist in the second extreme position.

During the movement between the first extreme position of FIG. 2 to the position shown in FIG. 3, power is continuously supplied to lamp assembly 24 because second end 50 of slide shoe 48 remains in electrical contact with shaft 56. Upon reaching the second extreme position, first end 52 of slide shoe 48 will be forced away from the conductive shaft 56 by first shoulder 68 of insulated collar 62. Because collar 62 is insulated, the lamp circuit is interrupted and flashlight 20 is in the OFF position. Due to conductive spring 98, absent pressure applied by an operator to actuator 30 in the direction of first end 14, housing assembly 302 will tend to move in the direction of second end 18. To alleviate the need for applying pressure on the actuator 30 at all times during operation, conductive shaft 56 is formed with a plurality of indentations 320 for engagement with slide shoe 48. Engagement of slide show 48 with one of the plurality of indentations 320 allows the user to release actuator 30 while maintaining the desired location of the lamp assembly 24 with respect to the reflector 90 and also maintains an electrical contact between slide shoe 48 and shaft 56. In addition to selectively focusing and activating the flashlight 10, the actuator 30 provides rolling resistance to the flashlight 10 so the it does not roll when placed on an uneven surface, such as the hood of an automobile.

Figure 4:
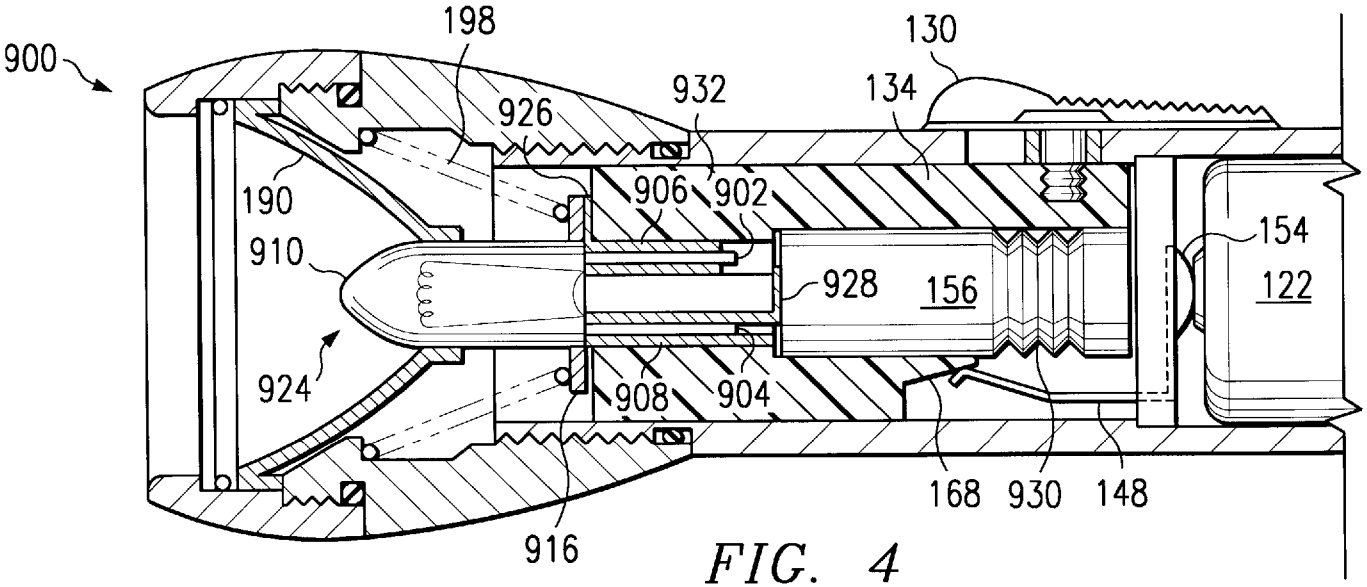
FIG. 4 is a cross sectional view of a portion of another embodiment of a flashlight according to the invention.

Another embodiment of the present invention is shown in FIG. 4, which illustrates a flashlight 900 using "AA" size batteries according to the teachings of the invention. The flashlight 900 shown in FIG. 4 is analogous to the one shown in FIGS. 1–3, except that it utilizes a bi-pin lamp assembly. A housing assembly 932, which is slidable within the flashlight, includes a housing 134, which surrounds a conductive shaft 156 and includes an insulated shoulder 168 abutting the conductive shaft 156. Slide shoe 148 engages with insulated shoulder 168 when the flashlight is in the OFF position (shown). As part of the housing assembly 932 and attached to the housing 134 is lamp assembly 924, which includes bulb 910 and two pins 902 and 904. Pin 902 is the negative contact of lamp assembly 924 and pin 904 is the positive contact. Pin 902 electrically engages with a negative conductive receptacle 906 positioned in housing 134, and pin 904 electrically engages with a positive conductive receptacle 908 positioned in housing 134. Negative conductive receptacle 906, which may be formed from metal, has a flat portion 926 for electrical engagement with a contact washer 916. Positive conductive receptacle 908, which may be formed from metal, has a flat portion for electrical engagement with shaft 156.

Abutting contact washer 916 is spring 198. Spring 198 urges housing assembly 932 in the direction of the batteries 122 and also provides an electrical contact between contact washer 916 and the head of the flashlight, which in turn provides electrical contact with the end cap and batteries as discussed in conjunction with the embodiment shown in FIGS. 1–3. In a similar manner to the embodiment shown in FIGS. 1–3, shaft 156 includes a plurality of indentations for selective engagement with slide shoe 148 for selectively focusing the flashlight, and slide shoe 148 may be positioned onto insulated shoulder 168 to selectively deactivate the flashlight.

When the flashlight is in the "ON" position (not shown), slide shoe 148 engages with conductive shaft 156 in a similar manner to the embodiment shown in FIG. 2. Engagement of slide shoe 148 with conductive shaft 156 complete the electrical circuit for the flashlight and thereby activates lamp assembly 924. The electrical circuit for the embodiment shown in FIG. 4 is as follows: The positive contact of the batteries couples with fastener 154, which couples to slide shoe 148, which in turn is electrically coupled to conductive shaft 156. Conductive shaft 156 is coupled to positive conductive receptacle 908 through flat portion 928. Positive conductive receptacle 908 couples with positive pin 904 of lamp assembly 924. Negative pin 906 couples with negative conductive receptacle 906, which couples with contact washer 916 through flat portion 926. Flat portion 926 couples with spring 198, which is electrically coupled to the flashlight head. The flashlight head is electrically coupled to the flashlight body, end cap, and finally to the negative contact of the batteries in the same manner as that described in conjunction with the embodiment shown in FIGS. 1–3. Selective focusing of the flashlight 900 shown in FIG. 4 is accomplished through selective positioning of housing assembly 932, and therefore lamp assembly 924, with respect to the reflector 190 through movement of actuator 130 in the same manner as that discussed in conjunction with the embodiment shown in FIGS. 1–3.

Numerous alternatives may be included with flashlight 10. For example, the embodiment shown in FIGS. 1–3 has the lamp assembly 24 moving relative to the fixed reflector 90, but in another embodiment, reflector 90 could move and lamp assembly 24 could be fixed with respect to head 16. Additionally, for example, in place of indentations 320 in shaft 56, a plurality of indentations may be formed proximate the actuator-receiving aperture 204 to hold actuator 30 in place, thereby maintaining the housing assembly 302 in position without applying pressure to actuator 30.

Although the present invention and its advantages have been described in detail, it should be understood that various changes, substitutions and modifications can be made without departing from the spirit and scope of the invention as defined by the following claims.

What is claimed is:

1. A flashlight comprising:

a flashlight body having a cavity therein and further having an actuator-receiving opening through a portion of the flashlight body;

a reflector for reflecting light, the reflector disposed within the cavity;

a lamp for producing light when energized, the lamp disposed within the cavity;

a housing assembly disposed within the cavity and moveable therein, the housing assembly comprising a housing;

an actuator extending into the actuator-receiving opening and coupled to the housing;

the lamp and reflector associated with the housing assembly whereby movement of the housing assembly allows relative movement of the lamp and the reflector to allow focusing of light from the lamp when an operator causes the actuator to move; and a biasing member for urging the housing and the actuator away from the reflector.

2. The flashlight of claim 1 wherein the reflector is secured to a portion of the body and the lamp is secured to the housing assembly.

3. The flashlight of claim 1 and further comprising a switch assembly for selectively energizing the lamp, the switch assembly comprising:

a conductive shaft attached to the housing and electrically connected to the lamp; and a slide shoe coupled at a first end to a battery contact and impinging upon the conductive shaft at a second end of the slide shoe.

4. The flashlight of claim 3 wherein the conductive shaft further comprises an insulated portion for engagement with the slide shoe.

5. The flashlight of claim 4 wherein the conductive shaft is formed with a plurality of indentations for engagement with the second end of the slide shoe.

6. A focusable flashlight comprising:

a body having a cavity therein, the body formed with an actuator-receiving aperture;

a head coupled to a first end of the body;

a reflector coupled to the head;

a lamp for producing light when energized, the lamp having first and second electrical contacts;

an actuator slidable within the actuator-receiving aperture;

a housing assembly disposed within the cavity and slidable therein for mechanically coupling the lamp to the actuator, the housing assembly comprising:

a housing having an end and an interior, the housing coupled to the actuator;

a conductive, longitudinal shaft protruding from the end of the housing and into the interior of the housing, the shaft having a first end and a second end, the first end electrically coupled to the first electrical contact on the lamp; and whereby movement of the actuator in the actuator-receiving aperture causes the housing assembly to slide relative to the reflector causing the lamp to move relative to the reflector to selectively focus the flashlight.

7. The flashlight of claim 6 further comprising a biasing means disposed between a portion of the head and housing assembly for urging the housing assembly away from the first end of the body.

8. The flashlight of claim 6 further comprising a slide shoe disposed within the cavity for electrically coupling to a power supply and for engagement with the conductive shaft.

9. The flashlight of claim 8, wherein the shaft is formed with a plurality of indentations for providing resistance to movement of the housing assembly.

10. The flashlight of claim 7 wherein:

the biasing means comprises a conductive spring;

the lamp comprises a bulb and a lamp jacket; and further comprising a slide shoe disposed within the cavity for engagement with the conductive shaft.

11. The flashlight of claim 6 wherein the body proximate the actuator-receiving opening is formed with a plurality of indentations for engagement with the actuator to provide resistance to movement of the housing assembly.

12. A method for selectively focusing a flashlight having a body with an exterior surface and having a reflector, the method comprising:

selectively sliding an actuator on the exterior surface of the flashlight body in a direction approximately parallel to a longitudinal axis of the body, the actuator connected to a moveable housing assembly having a lamp;

thereby selectively positioning the lamp relative to the reflector; and wherein the moveable housing assembly further comprises a housing and a conductive shaft, the conductive shaft attached to the housing and electrically coupled to the lamp.

13. The method of claim 12 wherein the movable housing assembly comprises a generally cylindrical housing, the housing slidable within the body.

14. The method of claim 12 and further comprising the step of closing an electrical circuit by sliding the actuator in a direction approximately parallel to the longitudinal axis of the flashlight, thereby selectively activating the flashlight.

15. The method of claim 13 and further comprising the step of electrically engaging the shaft with a slide shoe.

16. The method of claim 14 wherein the shaft is formed with a plurality of indentations and further comprising the step of selectively engaging the slide shoe with the indentations, thereby maintaining the lamp in a desired location.

17. The method of claim 12 wherein the lamp is a bi-pin lamp.

18. A flashlight comprising:

a flashlight body having a cavity therein and further having an actuator-receiving opening through a portion of the flashlight body;

a reflector for reflecting light, the reflector disposed within the cavity;

a lamp for producing light when energized, the lamp disposed within the cavity;

a housing assembly disposed within the cavity and moveable therein, the housing assembly comprising a housing;

an actuator extending into the actuator-receiving opening and coupled to the housing;

the lamp and reflector associated with the housing assembly whereby movement of the housing assembly allows relative movement of the lamp and the reflector to allow focusing of light from the lamp when an operator causes the actuator to move;

wherein the housing has a first end and further comprising a switch assembly for selectively energizing the lamp, the switch assembly comprising:

a conductive shaft protruding into the housing from the first end of the housing and electrically connected to the lamp; and a slide shoe coupled at a first end to a battery contact and impinging upon the shaft at a second end of the slide shoe.

19. The flashlight of claim 18 wherein the conductive shaft further comprises an insulated portion for engagement with the slide shoe.

20. The flashlight of claim 18 wherein the shaft is formed with a plurality of indentations for engagement with the second end of the slide shoe.

21. A flashlight comprising:

a flashlight body having a cavity therein and further having an actuator-receiving opening through a portion of the flashlight body;

a reflector for reflecting light, the reflector disposed within the cavity;

a lamp for producing light when energized, the lamp disposed within the cavity;

a housing assembly disposed within the cavity and moveable therein, the housing assembly comprising a housing:

an actuator extending into the actuator-receiving opening and coupled to the housing;

the lamp and reflector associated with the housing assembly whereby movement of the housing assembly allows relative movement of the lamp and the reflector to allow focusing of light from the lamp when an operator causes the actuator to move; and a switch assembly comprising:

a conductive shaft attached to the housing and electrically connected to the lamp; and a slide shoe coupled at a first end to a battery contact and impinging upon the shaft at a second end of the slide shoe.

22. The flashlight of claim 21 wherein the conductive shaft further comprises an insulated portion for engagement with the slide shoe.

23. The flashlight of claim 22 wherein the conductive shaft is formed with a plurality of indentations for engagement with the second end of the slide shoe.

24. A focusable flashlight comprising:

a body having a cavity therein, the body formed with an actuator-receiving aperture;

a head coupled to a first end of the body;

a reflector coupled to the head;

a lamp for producing light when energized, the lamp having first and second electrical contacts;

an actuator slidable within the actuator-receiving aperture;

a housing assembly disposed within the cavity and slidable therein for mechanically coupling the lamp to the actuator, the housing assembly comprising:

a housing having an interior, the housing coupled to the actuator;

a conductive, longitudinal shaft protruding into the interior of the housing, the shaft having a first end and a second end, the first end electrically coupled to the first electrical contact on the lamp; and whereby movement of the actuator in the actuator-receiving aperture causes the housing assembly to slide relative to the reflector causing the lamp to move relative to the reflector to selectively focus the flashlight.

25. The flashlight of claim 24 further comprising a biasing means disposed between a portion of the head and housing assembly for urging the housing assembly away from the first end of the body.

26. The flashlight of claim 24 further comprising a slide shoe disposed within the cavity for electrically coupling to a power supply and for engagement with the conductive shaft.

27. The flashlight of claim 24, wherein the shaft is formed with a plurality of indentations for providing resistance to movement of the housing assembly.

28. The flashlight of claim 25 wherein:

the biasing means comprises a conductive spring;

the lamp comprises a bulb and a lamp jacket; and further comprising a slide shoe disposed within the cavity for engagement with the conductive shaft.

29. The flashlight of claim 24 wherein the body is formed with a plurality of indentations proximate the actuator-receiving opening for engagement with the actuator to provide resistance to movement of the housing assembly.

* * * * *